US007374497B2

(12) United States Patent
Brown

(10) Patent No.: US 7,374,497 B2
(45) **Date of Patent: *May 20, 2008**

(54) GOLF PUTTER HEAD WITH VISUAL ALIGNMENT SYSTEM

(75) Inventor: James P. Brown, Stranmillis (IE)

(73) Assignee: Sienna Sport Limited, Northern Ireland ( * ) Notice: Subject to any disclaimer, the term of this patent is extended or adjusted under 35 U.S.C. 154(b) by 0 days.

This patent is subject to a terminal disclaimer.

(21) Appl. No.: 11/044,789

(22) Filed: Jan. 26, 2005

(65) Prior Publication Data

US 2006/0166755 A1 Jul. 27, 2006

(51) Int. Cl.
*A63B 69/36* (2006.01)
*A63B 53/04* (2006.01)

(52) U.S. Cl. ..... 473/251; 473/255; 473/340

(58) Field of Classification Search ..... 473/255, 473/251–254, 256, 249, 340–341; D21/736–746, D21/759

See application file for complete search history.

(56) References Cited

U.S. PATENT DOCUMENTS

| | | | | | |
|---|---|---|---|---|---|
| 1,537,320 | A | * | 5/1925 | Marsh | 473/255 |
| D233,616 | S | * | 11/1974 | Verzillo | D21/743 |
| 3,888,492 | A | * | 6/1975 | Cabot | 473/255 |
| 4,138,117 | A | * | 2/1979 | Dalton | 473/255 |
| 4,314,701 | A | * | 2/1982 | Swanson | 473/249 |
| D264,366 | S | * | 5/1982 | Roskopf et al. | D21/741 |
| D269,537 | S | * | 6/1983 | Tucker | D21/741 |
| 4,688,798 | A | * | 8/1987 | Pelz | 473/249 |
| 4,871,174 | A | * | 10/1989 | Kobayashi | 473/252 |
| 4,964,639 | A | * | 10/1990 | Tucker | 473/255 |
| D314,030 | S | | 1/1991 | Sanchez | D21/217 |
| 5,080,365 | A | * | 1/1992 | Winchell | 473/255 |
| D323,688 | S | * | 2/1992 | Whitney | D21/741 |
| 5,344,151 | A | * | 9/1994 | Anderson et al. | 473/337 |
| D357,292 | S | * | 4/1995 | Smith | D21/741 |
| D380,513 | S | * | 7/1997 | Noda | D21/736 |
| 5,795,239 | A | * | 8/1998 | Lin | 473/255 |
| D410,055 | S | * | 5/1999 | Loop | D21/736 |
| 5,993,324 | A | * | 11/1999 | Gammil | 473/251 |
| 6,406,380 | B1 | * | 6/2002 | Jackson | 473/340 |
| 6,497,628 | B1 | | 12/2002 | Gunderson | 473/313 |
| 6,702,689 | B2 | | 3/2004 | Ashton | 473/251 |
| 6,863,620 | B2 | * | 3/2005 | Tucker Sr. | 473/288 |
| D516,149 | S | * | 2/2006 | Gibson | D21/742 |

(Continued)

FOREIGN PATENT DOCUMENTS

DE 296 15 502 U1 11/1996

(Continued)

*Primary Examiner*—Sebastiano Passaniti
(74) *Attorney, Agent, or Firm*—Woodcock Washburn LLP

(57) ABSTRACT

A mallet-style golf ball putter with a hollow pipe component that has generally the same diameter as a golf ball, is positioned about the sweet spot in the vertical and lateral dimensions on the putter striking face, and extends longitudinally towards the rear of the putter to assist the golfer to align the striking face of the putter with the golf ball when in an address position and with the intended line of putt during takeback and follow-through. Peripheral weighting further enhances the moment of inertia of the golf putter head. The pipe component so designed permits a visual alignment of the striking face with the golf ball in the lateral and vertical dimensions and for a smooth perpendicular stroke along an axis of the pipe.

19 Claims, 3 Drawing Sheets

U.S. PATENT DOCUMENTS

| | | | | |
|---|---|---|---|---|
| 7,070,515 | B1 * | 7/2006 | Liu | 473/340 |
| D532,846 | S * | 11/2006 | Lee et al. | D21/736 |
| D541,894 | S * | 5/2007 | Imamoto | D21/736 |
| 2003/0207725 | A1 * | 11/2003 | Sanchez | 473/340 |
| 2006/0116216 | A1 * | 6/2006 | Sorenson | 473/313 |
| 2006/0128499 | A1 | 6/2006 | Yamanaka et al. | 473/340 |

FOREIGN PATENT DOCUMENTS

| | | |
|---|---|---|
| GB | 2 409 982 | 7/2005 |
| JP | 2001-62009 | 3/2001 |

* cited by examiner

GOLF PUTTER HEAD WITH VISUAL ALIGNMENT SYSTEM

CROSS-REFERENCE TO RELATED APPLICATIONS

The subject matter disclosed and claimed herein is related to the subject matter disclosed and claimed in U.S. Design patent application Ser. No. 29/222,352, filed Jan. 26, 2005, now U.S. Design Pat. No. D526,373.

FIELD OF THE INVENTION

The present invention relates to golf equipment and, more specifically, to a golf putter head having an alignment system that promotes a more consistent, repeatable golf stroke.

BACKGROUND OF THE INVENTION

Golf is a sport and a recreational activity that is a meant to be fun yet competitive. Perhaps the one area of the golf game that distresses and strikes fear and trepidation into many golfers is the art of putting, once defined as a "game within a game." To achieve a successful outcome, the golfer is required to align the putter head in three distinct planes or dimensions. In particular, he is required to align the putter head on the intended line of his putting stroke such that, at impact with the golf ball, the striking face of the putter head is delivered perfectly square to the ball and on a path of motion that is straight down the intended line of the putt. The golfer is also required to centre the face of the putter in a lateral plane from heel to toe of the putter head so that the point of impact of the golf ball is lined up precisely with the middle of the striking face. Perfect lateral alignment will eliminate twisting of the putter head in the heel-toe plane. The golfer is further required to align the putter striking face in the vertical plane so that the centre of the striking face impacts the ball on the equator of the ball, allowing the loft of the striking face to act efficiently on the ball and to improve the roll of the ball by minimizing backspin and skidding at impact. In a perfectly aligned orientation in all three dimensions, the ball will roll smoothly, stay on the intended line and reach the hole on target for the desired end result. A less than perfect 3-dimensional alignment will result in the force applied to the golf ball not having the intended effect on the travel of the ball.

Many prior art golf putters address one or two alignment dimensions but few address all three alignment dimensions. Those that do only do so to a very limited extent. An alignment system is desired that addresses all three alignment dimensions so that the golfer may develop repeatability and consistency in delivering the striking face to the ball in the same orientation, thereby allowing the golfer to correctly square the striking face to the intended line of the putt at address, to take the putter head away during the backstroke while maintaining a square-to-the-line orientation, and to deliver the putter head back to the golf ball in a square-to-the-line orientation. With constant, repeatable alignment in all three dimensions, the golfer will achieve improved performance in accuracy, ball speed and distance control.

Over the years, the golf industry has produced many golf putters designed to make the process of putting easier, less stress-inducing, and therefore more enjoyable for the golfer. However, many prior art golf putter heads are designed to increase the moment of inertia of the golf putter to reduce the adverse results of an off-centre strike, which is a very effective enhancement to better putting. Prior art golf putter designs generally focus on shifting mass to the sides and back of the clubhead to increase the moment of inertia, thereby reducing twisting and minimizing the undesirable effects of off-centre contact between the striking surface and the ball, including loss of distance and ball deviation from the intended line of the putt. Increasing the moment of inertia in this fashion also promotes better roll of the golf ball when struck. While this approach is beneficial to some extent, such golf putter head designs do not improve the opportunity for the golfer to align his club properly at address, takeaway the club properly on the backstroke, and keep the striking face square to the line on the forward stroke. In fact, few putter designs adequately address the difficulty that the majority of golfers have in consistently delivering the sweet spot on the striking face of the golf putter squarely to the golf ball. An alignment system is desired that allows the golfer to easily reference (e.g., using his peripheral vision) the fact that the golf putter is staying square to the intended line during the backstroke, the forward stroke and through impact with the golf ball.

Putting is often referred to as the mental part of the game of golf. Unfortunately, many prior art putter head designs complicate the mental part of the putting process by complicating the alignment system to the extent that it requires a high level of thought process before and during the putting stroke. Prior art golf putter head alignment systems generally try to relate painted or engraved markings or a series of indicia that are alien to the shape of a golf ball. For example, a flat plane visual alignment system is acceptable for a flat object like a ice hockey puck but is not intuitive for aligning a golf ball. Many prior art putter head designs introduce a complexity of angles, lines, points and other markings that, far from assisting the golfer with alignment, tend to distract and even disorient the golfer. Such putter head designs are not intuitive and lead to what has been aptly termed "paralysis by analysis." A more natural alignment system is desired that is optimally effective for the golfer in that it gives a much quicker assessment of the orientation of the striking face, thus avoiding an excessive amount of analysis on behalf of the golfer on face angle, sweet spot, line of putt, and the like, that often leads to tension, lack of certainty, and ultimately, poor putting performance.

Other prior art putter head designs use weighting rods, barrels, and cylinders of varying sizes that purportedly increase centre-weighting by concentrating an increased amount of mass behind the sweet-spot of the striking face. Unfortunately, these designs are inherently unforgiving on off-centre strikes. In some cases, such golf putter heads are also alleged to enhance alignment; however, such golf putter head designs are not much better than an elongated centre-line since the barrel edges do not relate to the edges of the golf ball and are also too short on the barrel to effectively assist with maintaining a square orientation of the striking face to the intended line of the putt.

An improved golf putter head design is desired that addresses these limitations in the designs of golf putter heads by simultaneously optimizing both the moment of inertia and alignment.

SUMMARY OF THE INVENTION

The present invention addresses the above-mentioned need in the art by providing a golf putter head having an intuitive and inherently more simple and user-friendly alignment system than the series of marks, dots, lines, right angle markings, and the like used in the prior art. The golf putter head of the present invention improves alignment by incorporating a pipe component into the golf putter head that has a diameter intended to substantially correspond to the diameter of the golf ball, that is laterally centred on the striking face of the gold putter head, and has a pipe length along the swing axis of the striking face that allows the golfer to focus on the putt itself as opposed to a geometrically complicated series of indicia, each serving a different function. The pipe itself is a unitary alignment system that without a series of indicia, ball shapes, or angles provides all the visual information required to allow the user to understand quickly the orientation of the putter both at address and during the motion of the putting stroke.

The golf putter head of the invention also has an improved resistance to twisting on off-centre hits in that its centre of gravity is low and back from the clubface. This also helps to get the ball rolling and to reduce skidding. In other words, by positioning more weight in the heel, toe and back of the putter head, a high moment of inertia and increased resistance to twisting on off-centre hits are provided.

The golf putter head with the integrated pipe element of the invention provides for a more natural, intuitive alignment system that allows the golfer to quickly and easily position the centre of the face of the putter on the centre of the golf ball, to align the putter on the intended line of the putt, to take away the putter along the intended line of the putt, and to return the putter back to the ball along the intended line of the putt in a manner that is optimally square to the intended line of the putt. Also, the high moment of inertia provided by positioning more weight in the heel, toe and back of the putter head helps to more efficiently transfer the energy generated in the putting stroke to the golf ball and therefore allows the golfer to control the distance and speed of the ball more effectively.

BRIEF DESCRIPTION OF THE DRAWINGS

The above-mentioned features and advantages of the invention will be apparent from the following detailed description in conjunction with the drawings, of which.

DETAILED DESCRIPTION OF ILLUSTRATIVE EMBODIMENTS

A detailed description of exemplary embodiments of the present invention will now be described with reference to FIGS. 1-8. Although this description provides detailed examples of possible implementations of the present invention, it should be noted that these details are intended to be exemplary and in no way delimit the scope of the invention.

Figure 1:
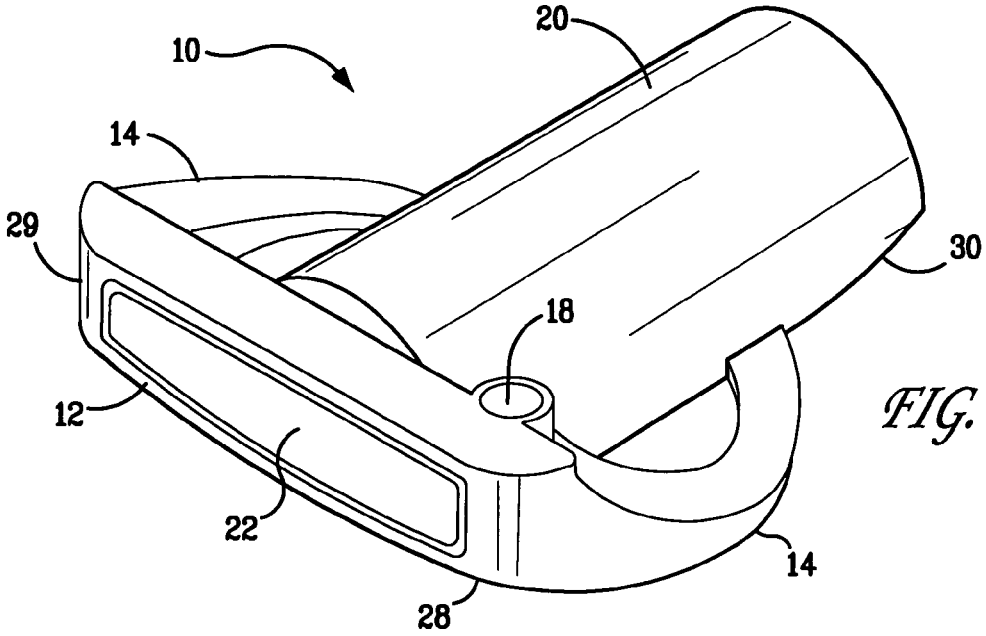
FIG. 1 illustrates a perspective view of a golf putter head with a pipe alignment system in accordance with the invention.
Figure 7:
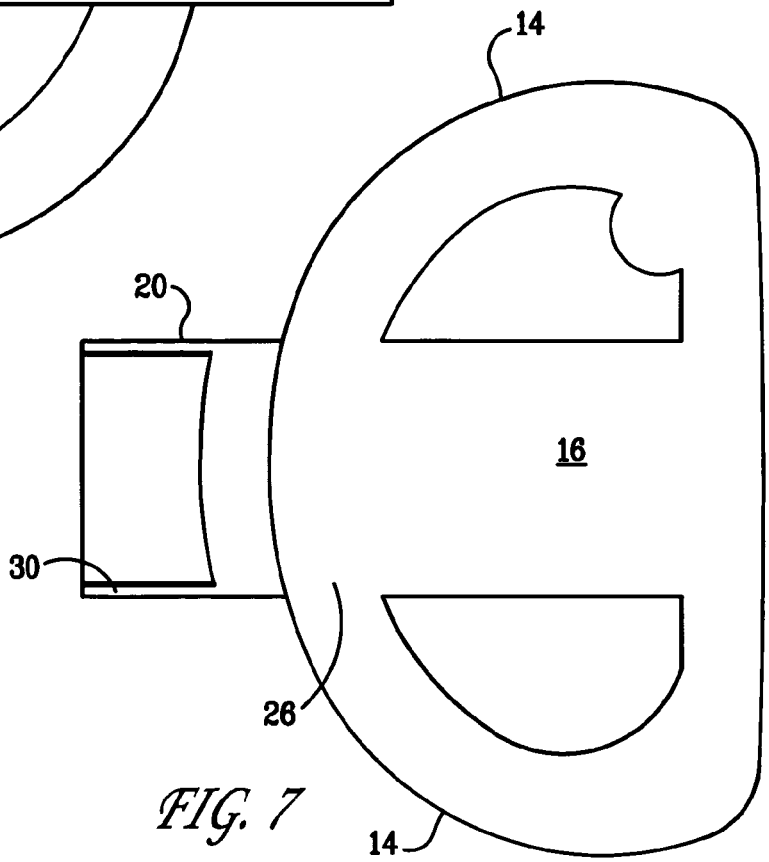
FIG. 7 illustrates a bottom view of the golf putter head of FIG. 1.

FIG. 1 illustrates a perspective view of a golf putter head 10 with a pipe alignment system in accordance with the invention. As illustrated, the golf putter head 10 includes a substantially planar strike face 12 that preferably includes a slight loft as best illustrated in the side views of FIGS. 3 and 4. The strike face 12 includes respective integral wings 14 that are also integrally formed with the support base 16 as best illustrated in FIG. 7. In an exemplary embodiment, the vertical height of the strike face 12 is approximately 1 inch, the thickness of the strike face 12 is approximately 0.3 inch to 0.4 inch, and the length of the strike face 12 from heel 28 to toe 29 is approximately 3.5 inches to 4.5 inches. A face insert of a polymer material may be inserted into the strike face 12 in accordance with known techniques.

In an exemplary embodiment, the strike face 12, wings 14 and support base 16 are formed as one integral molded piece using materials (e.g., titanium, carbon, steel, aluminum, zinc alloy, plastic, and the like) and molding techniques well-known to those skilled in the art. As illustrated, the exemplary embodiment also includes a hosel 18 formed in the molded piece with a size and shape suitable to accept a conventional golf club shaft.

Figure 2:
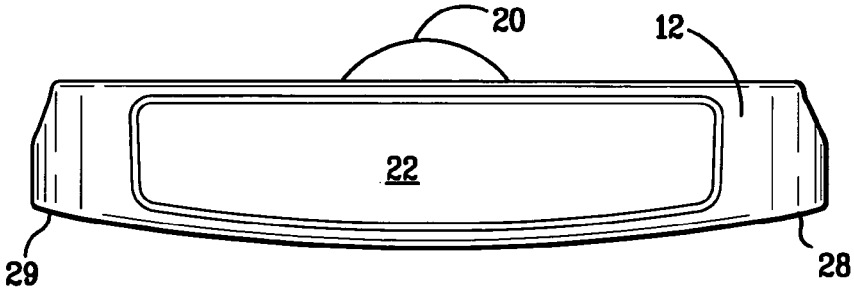
FIG. 2 illustrates the striking face of the golf putter head of FIG. 1.
Figure 3:
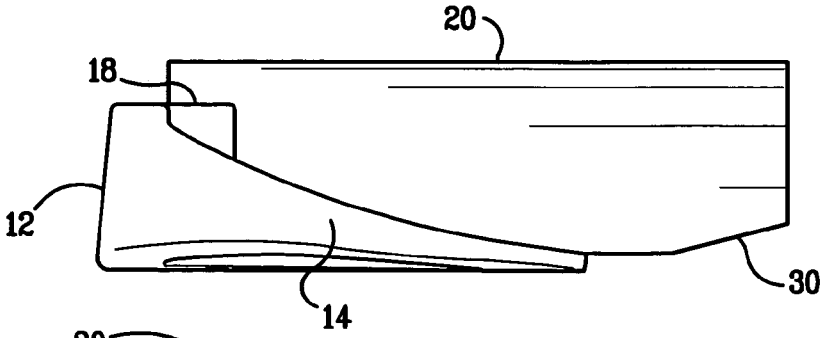
FIG. 3 illustrates a left side view of the golf putter head of FIG. 1.
Figure 5:
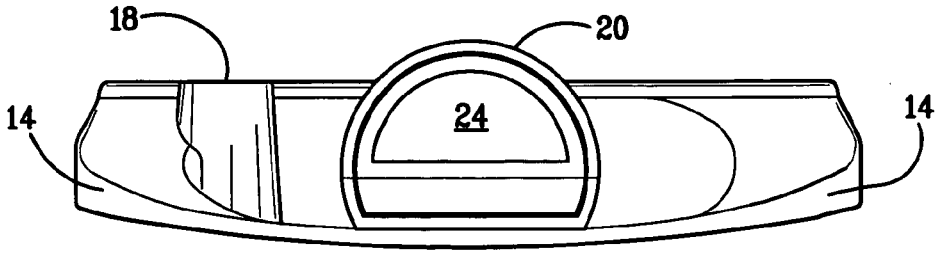
FIG. 5 illustrates a rear view of the golf putter head of FIG. 1.
Figure 6:
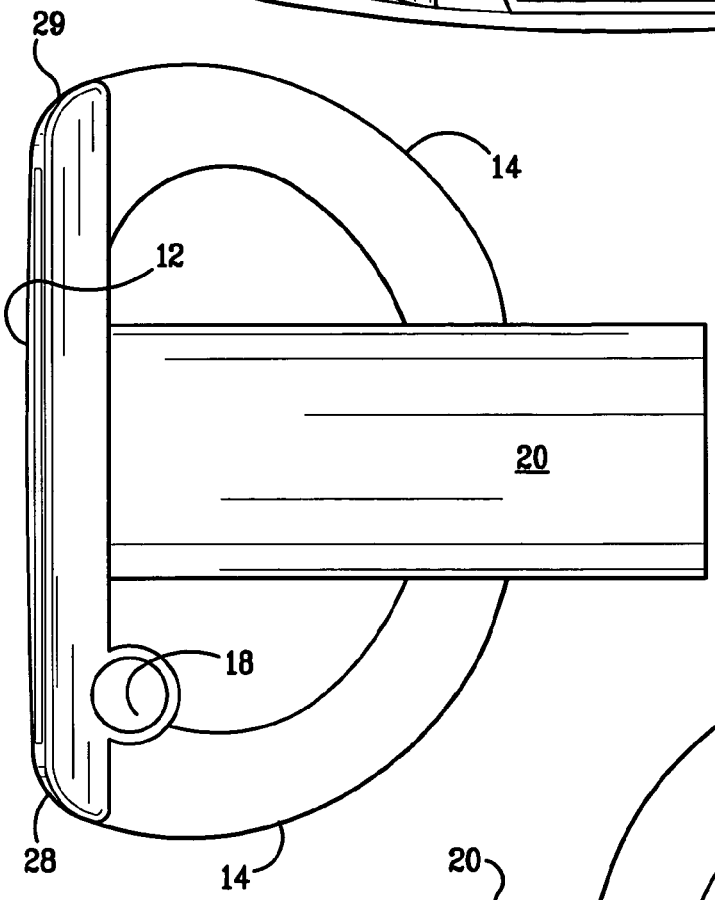
FIG. 6 illustrates a top view of the golf putter head of FIG. 1.
Figure 8:
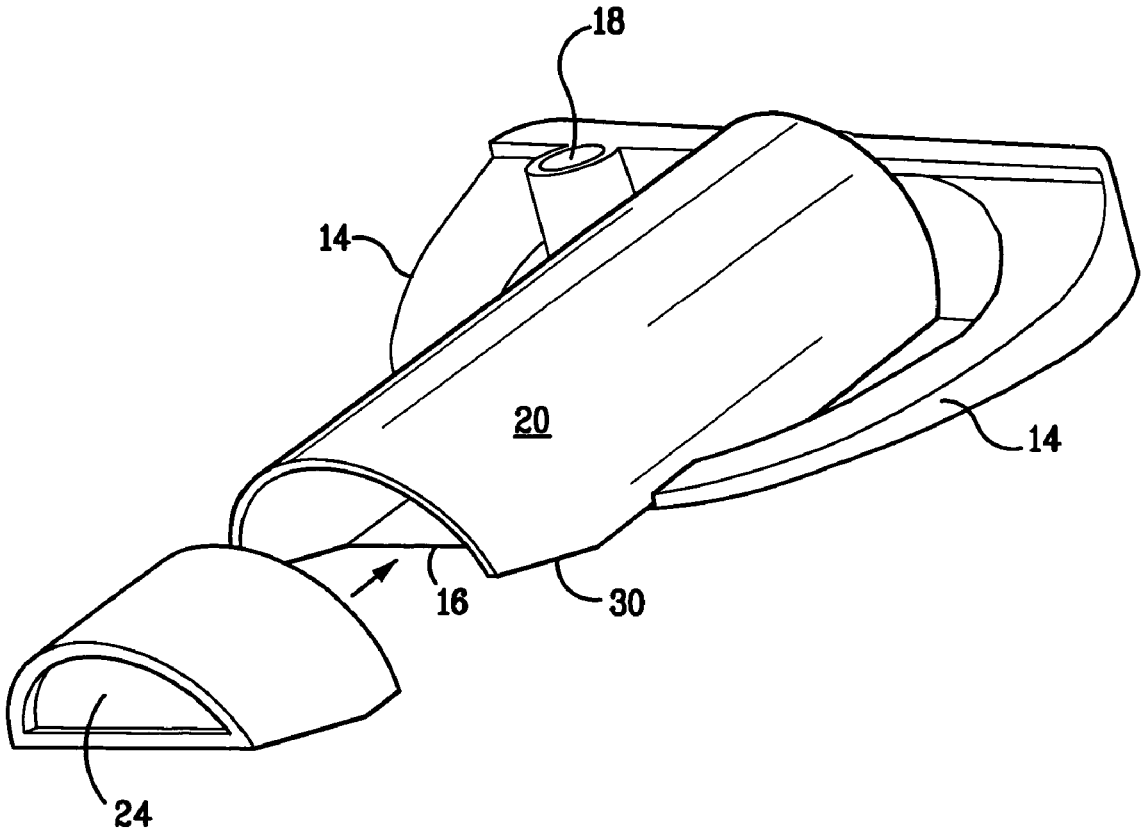
FIG. 8 illustrates a rear isometric view of the golf putter head of FIG. 1.

In accordance with the invention, the support base 16 supports a pipe 20 that is configured to have a diameter that is approximately the same as that of a conventional golf ball (e.g., within ⅛-¼ inch for improved and consistent vertical alignment) and has an apex which may extend vertically above the striking face 12 by about ⅛ to ¼ inch as illustrated in FIG. 2, and a length that is designed to permit ideal perpendicular alignment of the striking face 12 to the golf ball at the address position (prior to the backstroke) and to the line of the putt during the backstroke and forward stroke (e.g., the pipe 20 may extend 3.5 to 4.0 inches from the striking face 12, where a standard golf ball has a diameter of approximately 1.68 inches). The diameter of the pipe 20 is approximately the same size as a standard golf ball (1.68 inches). The pipe 20 may also be dimpled in the same fashion as the golf ball and may be white in color so as to have the same visual appearance as the golf ball, thereby contrasting with the surroundings and facilitating mental correlation of the putter head and putting stroke with the golf ball. The sheen of the pipe 20 may also be matched to the golf ball so as to further improve visual correlation of the golf putter head 10 with the golf ball. The pipe 20 extends from the rear of the striking face 12 at a lateral and vertical position centered around the sweet spot 22 of the striking face 12 as illustrated in FIGS. 1 and 2. The pipe 20 may be formed of any suitable material (e.g., titanium, carbon, steel, aluminum, zinc allow, plastic, and the like) and mounted on the support base 16 using any suitable adhering technique known to those skilled in the art (e.g., a screw, glue, welding, thermal bonding, etc.). As best illustrated in FIGS. 5 and 8, the height of the pipe 20 is designed to approximate that of the golf ball when the striking face 12 is in the proper position prior to striking the golf ball. Similarly, the lateral position of the pipe 20 is designed to approximate the diameter of the golf ball in a position centered around the sweet spot 22.

In an exemplary embodiment, the pipe 20 is hollow and is closed at the rear end with a plug 24 (FIG. 5) that fills all or part of the space between the pipe 20 and the support base 16. In the exemplary embodiment, the plug 24 is situated at the rear portion of the golf putter head 10 (i.e., the portion of the golf putter head 10 nearest the viewer in FIG. 5) and is weighted to move the center of gravity away from the striking face 12. Any extra weight for improving moment of inertia also may be distributed in the back portion 26 of the support base 16 and in the support wings towards the heel 28 and toe 29 of the striking face 12 (FIGS. 2-4), as well as in the rear portion of the plug 24 inserted into pipe 20. The plug 24 also may be formed of any suitable material for use in golf club heads including, for example, steel, carbon, aluminum, zinc alloy, titanium, plastic, and the like.

Figure 4:
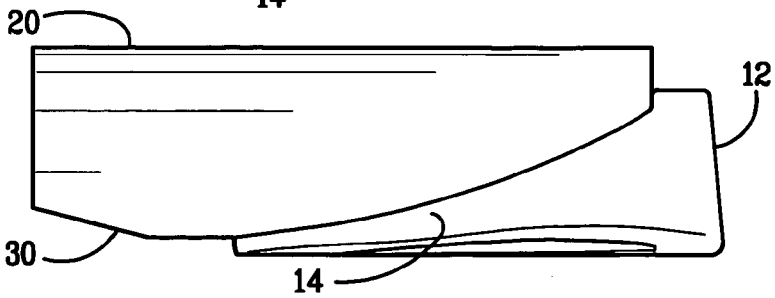
FIG. 4 illustrates a right side view of the golf putter head of FIG. 1.

FIG. 8 illustrates a rear isometric view of the golf putter head 10, including a view of the removed plug 24. As illustrated, the rear portion 30 of the pipe 20 is sufficiently canted at rear portion 30 to prevent the rear portion 30 of the pipe 20 from snagging the ground on takeaway and from contacting the ground during follow-through. As illustrated in FIG. 8, the bottom of pipe 20 is flat to define a suitable contact area on which the putter head sits at address. As best illustrated in FIGS. 4 and 8, the cross-section of the pipe 20 is thus somewhere between 180 and 360 degrees, with a flat bottom. The pipe 20 may be thin-walled and substantially hollow and/or may be partially solid to allow manipulation of the centre of gravity of the golf putter head 10. Also, the pipe 20 may have a square, upright back end that provides a visually square (right angle corners) pipe-end that is parallel to the strike face 12 so as to further facilitate alignment of the striking face 12 with the golf ball and the intended line of putt. The square back end of the pipe 20 further serves as a visual alignment on takeaway and during the backstroke.

The materials used to form the golf putter head 10 depend primarily on the desired overall weight for the golf putter head 10 and how the weight is to be positioned. In the illustrated embodiment, the golf putter head 10 can be a one piece construction with a plate or formed plastic plug 24 to close off the end of the pipe, or may be a two or more piece construction. In any of these embodiments, the main body of the golf putter head and the pipe 20 may be formed of steel, aluminium, zinc alloy, titanium, carbon, plastic, and the like.

In an alternative embodiment of the invention, the entire golf putter head 10, including the strike face 12, wings 14, support base 16, hosel 18, and pipe 20 may be formed of a single integral molded piece. In this embodiment, the flow of material in the mold is adjusted using known techniques so that extra volumes of material may be provided in the back portion 26 of the support base 16, in the support wings towards the heel 28 and toe 29, and in the rear portion of the pipe 20 (plug 24) so as to provide extra weight for improving moment of inertia.

Those skilled in the art will appreciate that since the dimensions and curvature of the pipe 20 of the invention are similar to the dimensions and curvature of the golf ball, the pipe 20 and the golf ball will visually merge into one continuous line in the golfer's peripheral view so as to provide a visual continuum that facilitates alignment. Since the pipe 20 and golf ball effectively form one straight line, it is easier for the golfer to judge when this line is not straight (and hence that the golf ball is not properly aligned to the sweet spot 22 of the striking face 12). In other words, there is a geometric relationship between the pipe 20 and the golf ball that is not available in conventional golf putter heads that simply use alignment marks and the like. Because of the shape and size of the pipe 20, during use the golf putter head 10 may give the golfer the feeling that the pipe 20 is "swallowing" the ball when properly aligned. This characteristic makes the golfer more acutely aware of the path of the putting stroke so that he may maintain consistency in direction and force.

Golfers readily appreciate that it is commonly recommended that the golfer positions his eyes directly over ball and thus directly over the intended line of the putt. However, many golfers do not do so or do not do so accurately. The pipe 20 of the golf putter head 10 of the invention addresses this problem by mimicking the shape of the cross-section of the golf ball, thereby giving the golfer a good reference to align the edges of the golf ball with the edges of the pipe 20. Hence, if the golfer has not positioned his eyes directly over the intended line of the putt using the golf putter head 10 of the invention, the pipe 20, because of its curvature, will still provide a good visual alignment with the edges of the golf ball.

Moreover, because of the preset lie of most putters and the preset angle of the shaft, the aiming and alignment devices are set according to the lie position. Typically, because indicia are generally positioned on flat static plains, when the golfer moves his eye or hand position the relationship between the golf ball and the alignment indicia are distorted. In accordance with the present invention, because the pipe 20 appears from the top to be substantially round, when the lie of the golf putter head 10 is changed, the pipe 20 rotates around its longitudinal axis, maintaining the relationship between the edges of the ball and the edges of the pipe, regardless of the eye position or lie.

Those skilled in the art will further appreciate that the pipe 20 further provides parallel edge lines defining the width of the golf ball, elongate parallel edge lines that run parallel to the intended line of the putt and perpendicular to the striking face 12 while framing the edges of the golf ball, an apex on the crown of the pipe 20 that indicates the lateral centre of the golf ball, and a square back end of the pipe that indicates when the putter head is square on the takeaway of the backswing. All of this is accomplished with one simple organic shape that the human eye can easily and quickly relate to, more so than a series of graphic lines, dots, angles, discs, chevrons, and arrows. The golfer need not think to align marks and points or angles; instead, alignment is reflexive and intuitive through association of similar shapes. Mis-alignment is very obvious, even to the unskilled or the beginning golfer. In this manner, the golf putter head 10 of the invention allows the golfer to follow the visual cues naturally, instinctively and intuitively.

In addition, those skilled in the art will appreciate that the longitudinal length of the pipe 20 permits the golfer to maintain a straight swing by keeping the pipe moving straight to the target along the line of the putt. The golfer need not be concerned with the overall shape, profile, footprint, or general visual mass of the golf putter head as the pipe 20 is visually dominant so as to guide the swing. As noted above, on takeaway the pipe 20 has the visual look of a ball, thereby permitting the golfer to see more easily when his takeaway is staying on line or, conversely, moving off-line. The golf putter head 10 of the invention permits the golfer to be more consistently accurate, as the pipe 20 permits the golf putter head 10 to be directed back along the intended line of putt and returned straight along the same line with the striking face 12 in a perfectly square alignment. Also, since the back end of the pipe 20 is square to the line of takeaway, it provides a good point of reference. On takeaway, the top of the pipe 20 and the square butt end of the pipe 20 make the golfer very aware when he is square to the intended line of putting or if he is executing the backswing off of the intended line.

Delivery of the striking face 12 in the correct vertical alignment allows the engineered weighting of the golf putter head 10 to operate most optimally. Thus, if the golf putter head is weighted so as to have a very low centre of gravity, then it will be appreciated that the pipe alignment feature of the invention further facilitates beneficial use of this low weighting design by assisting the golfer to deliver the striking face to the ball in a more consistent and accurate manner.

It is to be understood that the foregoing illustrative embodiments have been provided merely for the purpose of explanation and are in no way to be construed as limiting of the invention. Words used herein are words of description and illustration, rather than words of limitation. In addition, the advantages and objectives described herein may not be realized by each and every embodiment practicing the present invention. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention. For example, the golf putter head 10 of the invention may be configured to include rectangular bars, flat planes, and/or flat circular discs so that the shading and visual reference on the pipe 20 will match those on golf ball, thereby automatically drawing the pipe 20 and golf ball into position intuitively. Also, the pipe 20 may be constructed in one, two or more pieces. These and other features and advantages of the invention will be apparent from the following claims.

What is claimed is:

1. A golf putter head comprising:

a putter body including a striking face having a sweet spot, a central plate that abuts a rear portion of said striking face, and peripheral wings that connect said striking face to said central plate; and a pipe member that is positioned perpendicular to said striking face and above said central plate at a position substantially behind said sweet spot, said pipe member having a diameter that substantially corresponds to that of a golf ball and a length that is sufficient to align the pipe with the golf ball in an address position and on a line of a putt during takeback and follow-through of the golf putter head.

2. The golf putter head of claim 1, wherein the striking face is substantially rectangular in shape.

3. The golf putter head of claim 1, wherein the pipe member has at least one of a color and a texture similar to that of a golf ball.

4. The golf putter head of claim 1, wherein each peripheral wing is approximately semi-circular in shape and defines respective holes between each peripheral wing and said central plate.

5. The golf putter head of claim 1, wherein at least one of the peripheral wings, a rear portion of the central plate, and a rear portion of the pipe member is weighted so as to move a center of gravity of said golf putter head away from said sweet spot.

6. The golf putter head of claim 1, wherein said putter body further comprises a hosel that accepts a golf club shaft.

7. The golf putter head of claim 1, wherein the putter body and the pipe member are formed separately and connected to each other.

8. The golf putter head of claim 7, wherein the putter body and the pipe member are each formed of at least one of the following materials: steel, aluminium, zinc alloy, titanium, carbon and plastic.

9. The golf putter head of claim 1, wherein the putter body and the pipe member are integrally formed.

10. The golf putter head of claim 9, wherein the putter body and the pipe member are integrally formed of one of the following materials: steel, aluminium, zinc alloy, titanium, carbon and plastic.

11. The golf putter head of claim 1, wherein the central plate has a width that equals a width of a flat bottom of the pipe member.

12. The golf putter head of claim 11, wherein the pipe member has a cross section with a flat side and an angle of curvature connected to the flat side that extends at least 180 degrees and less than 360 degrees.

13. The golf putter head of claim 1, wherein the length of the pipe member is at least twice the diameter of a golf ball.

14. The golf putter head of claim 1, wherein a back end of the pipe member is canted up so that a bottom of the pipe member does not catch on the putting surface during the backswing or during the follow through.

15. The golf putter head of claim 1, wherein an apex of the pipe member is higher than a top of the striking face by approximately ⅛ to ¼ inch.

16. The golf putter head of claim 1, wherein the pipe member is hollow.

17. The golf putter head of claim 16, further comprising a plug placed in an open back end of the hollow pipe member.

18. The golf putter head of claim 17, wherein the plug is weighted so as to move a center of gravity of the golf head putter away from the sweet spot.

19. The golf putter head of claim 1, wherein a back end of said pipe member remote from said striking face has a face that is parallel to said strike face when viewed in an address position.

* * * * *